United States Patent [19]

Cornell et al.

[11] Patent Number: 5,046,217

[45] Date of Patent: Sep. 10, 1991

[54] HORIZONTIAL MINI BLIND CLEANER

[76] Inventors: Robert W. Cornell, 4401 Pinetree Close; William A. Cain, Rte. 1, Cloud Cir., both of Cumming, Ga. 30130

[21] Appl. No.: 496,363

[22] Filed: Mar. 20, 1990

[51] Int. Cl.[5] ..... A47L 7/00; A47L 5/00; A47L 9/06

[52] U.S. Cl. ..... 15/322; 15/394; 15/395; 15/321

[58] Field of Search ..... 15/321, 322, 394, 395

[56] References Cited

U.S. PATENT DOCUMENTS

| | | | |
|---|---|---|---|
| 2,270,579 | 1/1942 | Chamberlin et al. | 15/321 |
| 2,789,307 | 4/1957 | Sussman et al. | 15/394 |
| 3,355,762 | 12/1967 | Cavell et al. | 15/321 |
| 3,445,880 | 5/1969 | Warner | 15/210 A |
| 3,616,482 | 11/1971 | Brycki | 15/321 |
| 3,643,277 | 2/1972 | Durst | 15/77 |
| 3,747,155 | 7/1973 | Koellisch | 15/321 |
| 4,074,387 | 2/1978 | Arato et al. | 15/322 |
| 4,083,077 | 4/1978 | Knight et al. | 15/321 |
| 4,483,037 | 11/1984 | Jacobson | 15/210 A |
| 4,574,415 | 3/1986 | Vitronis | 15/114 |
| 4,720,889 | 1/1988 | Grave | 15/322 |

FOREIGN PATENT DOCUMENTS

| | | | |
|---|---|---|---|
| 916737 | 1/1963 | United Kingdom | 15/394 |

*Primary Examiner*—Jimmy G. Foster
*Assistant Examiner*—M. D. Patterson

[57] ABSTRACT

A blind cleaner for mini blinds has a handle with an operating center at one end. The handle includes connections for a supply of water and detergent under pressure, and for a vacuum line. The operating center includes a nozzle from which water is dispensed, the nozzle being covered by foam for dispersion of the water. Both the water supply and the vacuum are connected to the operating center. There are holes in the operating center for allowing air to pass into the device. The result is that water is dispensed to clean a surface, and the vacuum removes the water and dirt and prevents spilling of water.

4 Claims, 3 Drawing Sheets

HORIZONTIAL MINI BLIND CLEANER

BACKGROUND—FIELD OF INVENTION

At the outset let me state that the above named parties are co-inventors in the truest sense. My personal expertise is in the field of janitorial maintenance, an endeavor I have chosen to pursue for the past seventeen years. Mr. Cain has spent 25 years in the machine shop-fabrication field and obviously has acquired a great amount of experience in this area. While I have become aware of a tremendous void in the janitorial maintenance field for a good mini blind cleaner, it was through the innovation of Mr. Cain that we have been able to produce a satisfactory test model. The conception of our idea was finalized on May 18, 1989 with the reduction to practice occurring on June 2, 1989.

The principle of our invention is first and foremost, to be able to clean the blinds while they are in position. In otherwords to be able to clean the blinds without having to move them. While it is possible to clean the blinds if they are higher than the hand can reach with the aid of an extension pole, we strongly recommend for both control and inspection, that the work be performed while the operator is on a step ladder of appropriate height. It is important to emphasize that our invention has a balance between the force of the water flow and the vacuum and therefore our invention does not spray water onto flooring, desks, windows or the like. Also in view of the fact that the water flow is diffused twice there is no ullage.

Secondly, in order to clean the blinds most efficiently they should be cleaned with water. To be more specific, water and a cleaning chemical. This places the foreign matter from the blind surface into suspension whereupon it is then vacuumed into a recovery tank. For pressurized water and a vacuum source we utilize an extraction carpet cleaner unit. We also use the solution and recovery tanks of the extraction unit. However, may we stipulate that a pressurized water unit with a vacuum, solution tank and recovery tank could be also produced for our blind cleaner.

A description of our unit is difficult to put into words, and indeed the reader can best obtain a more thorough knowledge of our invention through study of our drawings and subsequent claims, however a fine attempt in wording shall now be made.

At the rear of the top lateral portion of the singular handle is a quick release fitting extending outwardly from the handle approximately 5.5 cm. This quick release fitting is 1.75 cm in diameter at the connecting orifice. The quick release fitting is connected to a ⅜ of an inch in diameter nipple (or approximately a 1 cm in diameter nipple).

The nipple as aforementioned, extends on the outside of the handle approximately 1.5 cm and from the quick release fitting it is immediately bent in approximately a 10 degree angular bend. A square 2.5 by 2.5 cm and an attached rubber grommet holds the nipple securely and at the correct angle. The square is secured to the handle by means of two screws. The nipple then extends through the top portion of the operating handle approximately 13 cm to the front operating center. The front operating center is approximately 4 cm in length and 5.5 cm in width and 1.5 cm in height. The front portion of the front operating center is beveled so that it can more easily be projected between the lateral blinds. The beveling starts at approximately 3.5 cm from the distal portion of the front operating center, and is beveled at approximately a 25 degree angle on both the top and bottom sides. The beveling thence comes to an end at the rounded front portion of the front operating center, which is approximately 0.75 cm in height and approximately 5 cm in width. The remaining 0.5 cm of the beveled front operating center is beveled inwardly at also an approximate 25 degree angle, with 0.25 cm beveled inwardly on each side.

The front operating center is secured to the top portion of the handle by means of two hexagonal screws abutted on the top portion of the lateral operating handle in apposition to a flange approximately 0.8 cm in width. This flange is on either side of the lateral operating handle at its distal location.

The top portion of the lateral operating handle extends backwardly approximately 13 cm in a lateral operating position. The bottom portion of the lateral operating handle is approximately 2.5 cm in height. The bottom portion of the lateral operating handle extends backwardly approximately 8.25 cm whence the singular handle extends downwardly or vertically in approximately a 75 degree angle. The lateral top portion being rectangular with the vertical portion being cylindrical in nature and approximately 3.5 cm in diameter and approximately 15 cm in length. Were the reader viewing our invention from above he would see that the lateral top portion of the handle expands from approximately 2.5 cm at the rear to 4.5 cm at the frontal or distal portion. The front operating center has three holes drilled on the bottom side, the holes approximately 1.016 mm in diameter. The water and cleaning chemical flow through these holes onto the subject matter to be cleaned. In order to dissipate the water flow and completely eliminate the possibility of ullage there is a sheet, approximately 0.254 mm in thickness placed over the holes. The sheet is glued at either end by means of contact cement. Although our invention test model is constructed of extruded aluminum, our perferred embodiment is that of molded plastic with the sheet over the holes being also plastic. For the optimum operation this sheet should be glued to the plastic front operating handle by means of the most appropriate glue at either end. The sheet is rectangular having the dimensions of approximately 2 cm in length and 0.8 cm in width.

The water is forced through the approximate 1 cm in diameter nipple to the front operating center, and outwardly through the three holes under approximately 50 p.s.i. On either side of these three jet-like holes is a suction or vacuum cavity approximately 1 cm in width and 2 cm in length. The depth of these cavities is approximately 0.75 cm. The front operating center has one additional vacuum hole on each side of its width portion, said holes being circular and approximately 0.6 cm in diameter. In addition to these there are two vacuum holes on the top of the front operating center, circular in nature and approximately 1 cm in diameter. The total amount of vacuum that is pulled through the combined six vacuum holes is very strong and is measured at 135 inches of water lift. For further dissipation of water and cleaning chemical, we have placed over the top, beveled end and the bottom of the front operating center a piece of foam of the approximate dimensions, 7.0 cm in length, 7.0 cm in width and 0.5 cm in thickness. In order to secure the foam to the front operating center we have utilized a quick release connecting mechanism similar in nature to "VELCRO" hoop and loop fastener. One female strip is placed at either end of the foam by means of an adhesive, and the strips are approximately 1 cm in width by 7.0 cm in length. One male strip of the same dimensions as the female strip is placed at the very back portion of the front operating center by means of an adhesive, on both the top and bottom portions of the front operating center. The aforementioned foam also enhances the cleaning effectiveness of our invention.

BACKGROUND—DESCRIPTION OF PRIOR ART

Heretofore, when cleaning blinds it was necessary to either physically take the blinds down and place them into an ultra-sonic blind cleaner or take them outdoors and wash off with a water hose and cleaning chemical and subsequently let them sun dry. This latter drying process presents many problems, as well as do the natural elements, i.e., rain, temperature, humidity, etc.

Also heretofore, if one wanted to clean the blinds while they were in position it was necessary to perform the laborious task of cleaning the blinds with a mini blind cleaner which has five or seven finger like projections fitting in between the blinds. Over each projection there is a soft, wool-like fabric. As the blind cleaner is moved in a nutational manner the dust and foreign matter on the blinds is transferred from the blinds to the fabric. The two principal objections to this process are that it is very time consuming and if the blinds are the least bit dirty the wool-like fabric becomes very dirty, very fast, thus decreasing its cleaning efficiency. Also one can clean the blinds when they are in place with a moistened rag and cleaning solution. The two principal objections to this method are that it first of all is not efficient, with the back 0.5 cm of the blinds virtually unreachable and also it is very time consuming. If the blinds are cleaned in place with the aforementioned processes dust accumulation or foreign matter from the blind surface can be easily transferred to desks, flooring, counters, etc. when attempting to clean the blinds. With our invention the blinds may be cleaned in place and they may be cleaned with both rapidity and efficiency as all loose dust and/or foreign matter on the blinds is placed into a suspension of water and cleaning chemical and vacuumed into a recovery tank.

OBJECTS AND ADVANTAGES

Accordingly we claim the following objects and advantages of our invention: First of all the advantages listed, it is not necessary to transfer the blinds when they are cleaned with our invention. Secondly, the cleaning of the blinds with our invention is performed with rapidity. Thirdly, when the blinds are cleaned with our invention the cleaning is very efficient. Forth, and this point is extremely important, when cleaning the blinds or the like with our invention no loose dust accumulation or foreign matter is transferred from the blinds to desk tops, flooring, counters, or the like. Fifth, the purpose of the vacuum holes on the top portion of the front operating center is to create a suction between the top portion of the front operating center and the underside of the blinds. This not only provides a cleaning of the underside of the blinds, which in reality are not very dirty, but more importantly the suction created between the top portion of the front operating center and the underside portion of the blinds increases the rapidity of the cleaning process through use of our invention. Sixth, the two end portions of the mini blinds are more efficiently cleaned due to this suction. And finally our invention has a balance between the water flow and the suction of the vacuum. Therefore our invention does not spray water onto flooring, desk tops, windows or the like. Rather the water flow is totally self-contained and remains on the foam. This self-containment of the water flow is also due in part to the double diffusion of the water flow, first by the sheet of thin material placed over the holes through which the water flows onto the blinds and then by the foam placed over the front operating center. Readers will find further objects and advantages of our invention from consideration of the ensuing description and accompanying drawings.

DRAWING FIGURES

DRAWING REFERENCE NUMERALS

Figure 1:
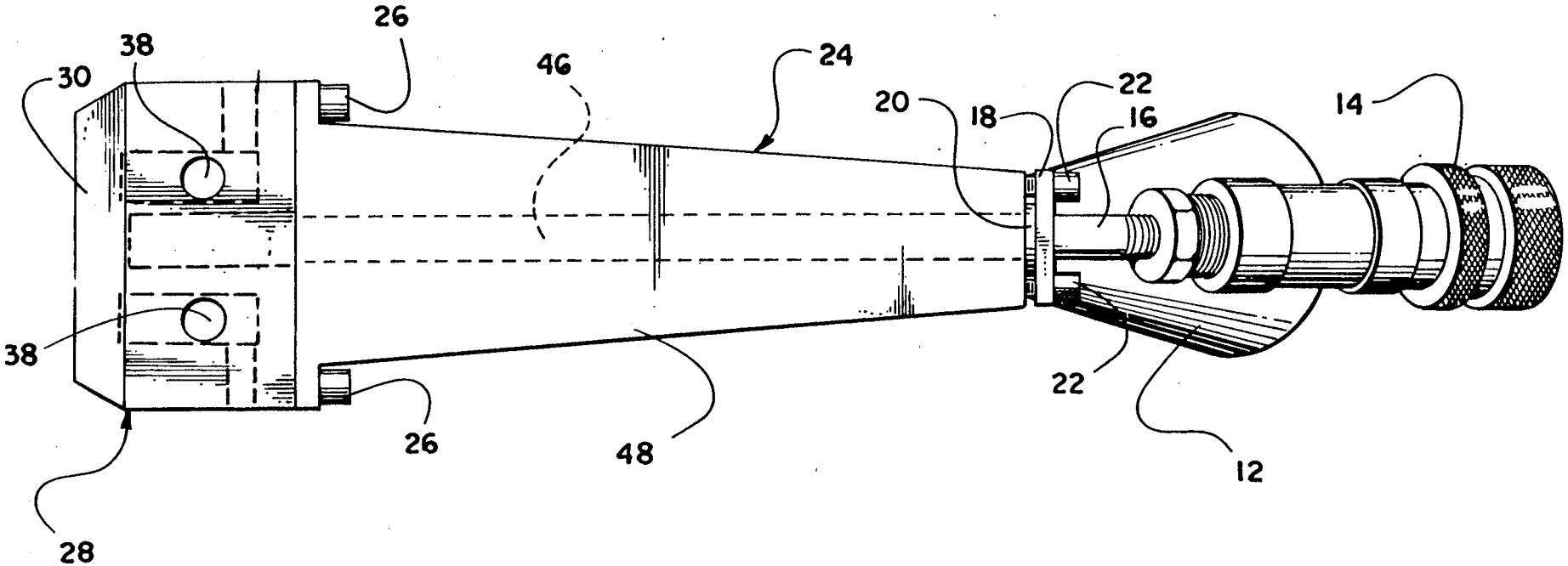
FIG. 1 shows a top view of our invention.
Figure 2:
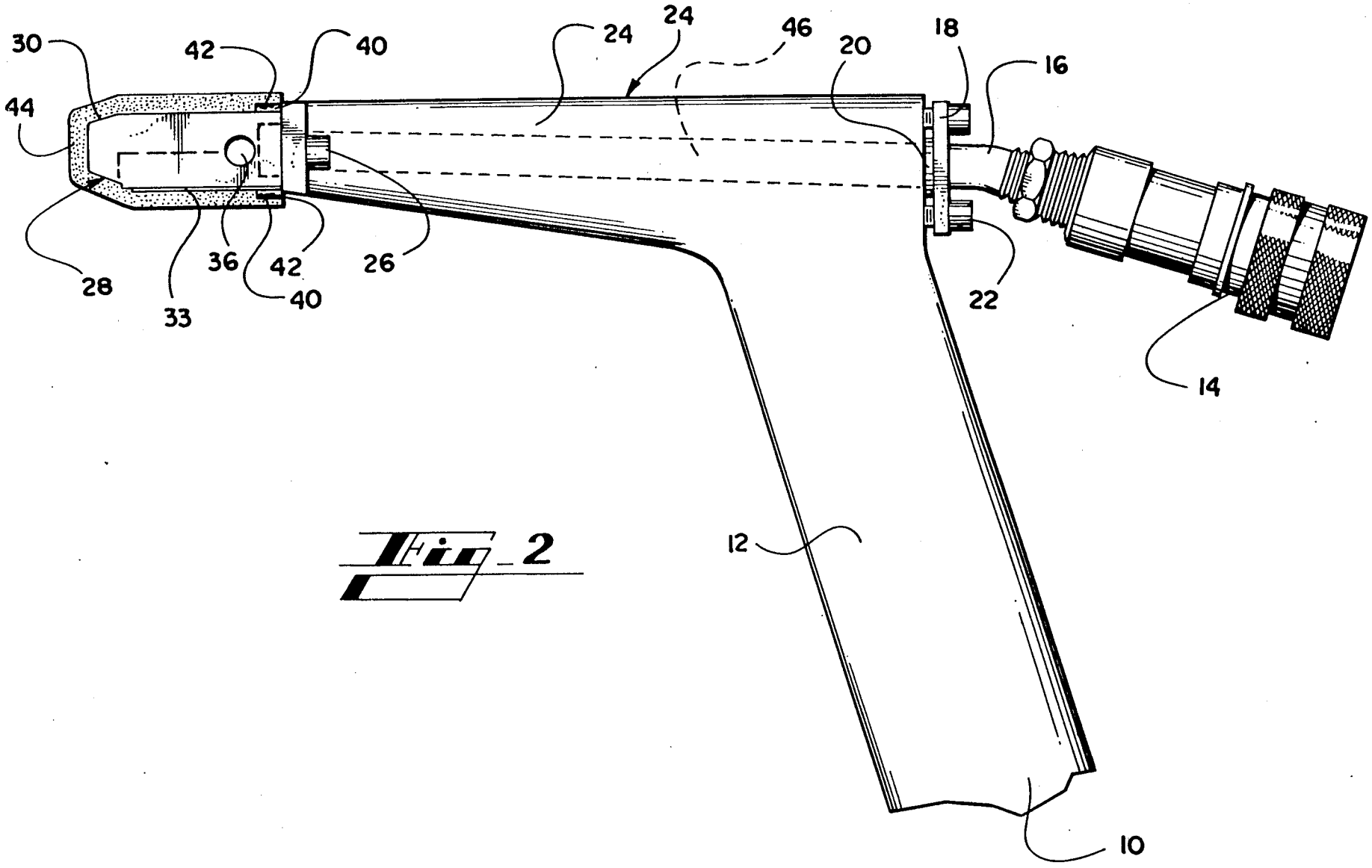
FIG. 2 shows a side view of our invention showing the foam material over the operating center.
Figure 3:
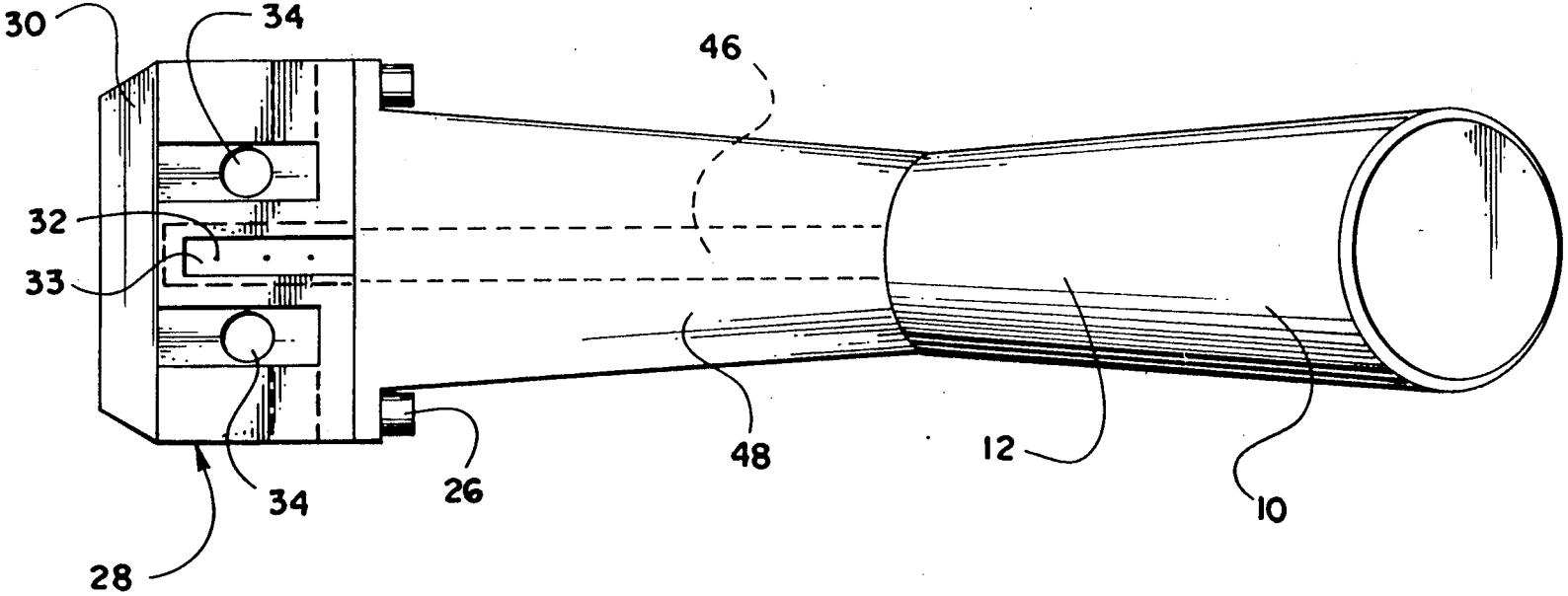
FIG. 3 shows a bottom view of our invention.

10 opening of cylindrical handle, 3.5 cm in diameter, to which the vacuum hose attaches
12 vertical operating handle, approximately 15 cm in length
14 1.75 cm in diameter orifice quick release fitting
16 exterior portion of 1 cm in diameter nipple
18 square 2.5 by 2.5 cm which holds nipple in place
20 rubber grommet which strengthens placement of the 1 cm nipple
22 screws that secure the aforementioned square and grommet to the lateral operating handle
24 lateral operating handle
26 hexagonal screws that secure front operating center to the lateral operating handle
28 front operating center
30 beveled portion of front operating center
32 holes 1.016 mm in diameter through which water and cleaning solution flow
33 sheet of material 0.254 mm in thickness which acts as a primary diffuser for the water flow
34 vacuum cavities located on either side of holes (32) and positioned on the bottom side of the front operating center.
36 vacuum holes located on the side portion of the front operating center
38 vacuum holes located on the top portion of the front operating center
40 connecting mechanism adhesively attached to the front operating center
42 connecting mechanism adhesively attached to the foam
44 foam which fits over the front operating center
46 phantom drawing of 1 cm in diameter nipple which transfers water from the visible portion of nipple (16) to the front operating center
48 interior cavity of the handle (24)(12) through which vacuum flows to 10

DESCRIPTION

Our invention consists of a singular piece of extruded aluminum, although our preferred embodiment is that of molded plastic. The overall invention includes the vertical operating handle (12), the quick release fitting (14) into which a pressurized water hose connects, the exterior portion of the 1 cm nipple (16) through which water flows (46) to the front operating center. At the rear of the lateral operating handle (24) is a square 2.5 by 2.5 cm (18) and a rubber grommet (20) which holds the 1 cm nipple (16) in place. The approximate dimensions of the vertical operating handle (12) are 15 cm in length and 3.5 cm in diameter. The lateral operating handle (24) extends forward from its rear portion to the front operating center (28) approximately 12 cm at the top portion of the lateral operating handle (24) and approximately 8.5 cm from the vertical operating handle (12) to the front operating center (28) at the bottom portion of lateral operating handle (24). The front operating center (28) is secured to the lateral operating handle (24) by means of two hexagonal screws (26). We then show the front operating center (28) in which all of the activity apexes, i.e., in which the actual cleaning process takes place. The beveled portion (30) of the front operating center (28) allows our invention better access to project in between the blinds. The holes (32) through which the pressurized water solution flows onto the surfaces to be cleaned are positioned in the center of the front operating center. A diffuser for the pressurized water flow, is a thin sheet of material 0.254 mm in thickness (33) which covers the holes (32) on either side of which is located a vacuum cavity (34). Both the solution holes (32) and the vacuum cavities (34) are located on the bottom portion of the front operating center (28). There is also one vacuum hole (36) located on either side of the front operating center (28) and two vacuum holes (38) located on the top portion of the front operating center (28). The connecting mechanism (40) attached to both the top and bottom portions of the front operating center (28) intermeshes with the connecting mechanism (42) which is attached to both ends of the foam (44) so that the foam fits securely over the front operating center (28).

OPERATION

The purpose of our invention is to provide the very best of cleaning of both horizontal or vertical surfaces such as blinds, which may we state can be either maxi or mini in variety. However, as it has been projected that there will be 1.4 billion mini blinds in place by the year 1998 A.D., our invention was primarily designed to clean mini blinds. Through the use of our invention the blinds may be cleaned in place. A vacuum hose approximately 3.5 cm in diameter is attached to the vertical operating handle (12) at (10). The vertical operating handle (12) is hand held by operator of the blind cleaner. Should it be necessary to clean blinds or the like above hand level, we recommend that for purposes of both control and inspection, that the operator be on a step ladder.

The vacuum hose is attached on the other end to a vacuum source which draws a vacuum measured at 135 inches of water lift. The quick release fitting (14), which in reality is not part of our invention, is attached to a pressurized water hose approximately 1.75 cm in diameter. The other end of this pressurized water hose is attached to a pressurized water source which forces water solution to the front operating center (28) under approximately 50 pounds per square inches of water pressure. In operation we recommend that the cleaning chemical be placed in with the water, in the solution tank, in approximately a 30 part water to 1 part cleaning chemical. The water solution is then forced through the 1 cm nipple (16) and (46) to the front operating center and outward through the 1.016 mm in diameter holes (32) onto the surface to be cleaned. As the blind cleaner is moved in a nutational manner, water and cleaning chemical further are dissipated through the foam (44) onto the aforementioned surface. Dust accumulation and foreign matter on the surface to be cleaned are placed in suspension with the water and cleaning chemical.

This suspension is then vacuumed off the surfaces to be cleaned by means of the vacuum cavities (34) under a vacuum measurement of approximately 135 inches of water lift. The solution with the dirt in suspension flows backward through the interior cavity (48) of the handle, through the 3.5 cm in diameter vacuum hose into a recovery tank.

We want to emphasize that with our invention, the blinds may be cleaned without having to move them and also due to the fact that foreign matter to be removed from the blind surface is placed into suspension, the foreign matter is not transferred from the blinds to other surfaces such as desk tops, counters, flooring, or the like while undergoing cleaning with our invention.

While the aforementioned description discloses many specificities, the reader should not assume in any way that our invention is limited by these specifications. Rather the reader should accept them as exemplifications of the preferred embodiments. Those skilled in the art can easily envision several other variations within its scope. For example the blind cleaner may be constructed of many different materials such as extruded aluminum, metal, molded plastic, and indeed the list of materials of construction are very numerous. Also those skilled in the art can easily provide different dimensions, however the reader is requested to determine the scope of the invention by reading the appended claims and not by the aforementioned examples.

We claim:

1. A cleaning tool comprising two segments;

(a) the first segment including a vertical operating handle connected to a lateral operating handle forming a vacuum chamber connected to a vacuum source at the bottom of said vertical operating handle, an elongated nipple passing through said chamber and extending the length of said lateral operating handle through which water flows, (b) the second segment including a front operating center, said center including a plurality of foramina through which water and at least one cleaning chemical flows and a plurality of vacuum holes, connected to said lateral operating handle, said foramina covered by a thin piece of rectangular material bonded to said front operating center with contact cement, said rectangular material being surrounded by foam detachably connected to the front operating center by detachable means, whereby water and cleaning chemical pass out of the foramina, through the foam after having been dispersed by the rectangular material and thereafter returns through the vacuum holes and into a recovery tank by means of a vacuum applied to the vertical operating handle.

2. A cleaning tool for cleaning mini blinds, said cleaning tool comprising a handle, an operating center at the forward end of said handle, first conduit means connected to said operating center for connection to a liquid supply of water and cleaning chemical, second conduit means connected to said operating center for connection to a source of vacuum, said operating center defining a plurality of foramina therein, a cover for said foramina bonded to said operating center and covering said foramina for dispersing liquid passing through said foramina, said operating center further defining a plurality of vacuum holes, a first pair of holes of said plurality of vacuum holes being laterally displaced from said foramina, and foam material covering said cover and said first pair of holes for further dispersing said liquid, the arrangement being such that liquid emitted from said foramina will be received by said first pair of holes.

3. A cleaning tool as claimed in claim 2, and further including fastening means for releasably fastening said foam material to said operating center.

4. A cleaning tool as claimed in claim 3, said plurality of vacuum holes further including a second pair of holes defined in the upper surface of said operating center and a third pair of holes defined in the sides of said operating center.

* * * * *